United States Patent [19]

Auclair

[11] Patent Number: 4,784,621

[45] Date of Patent: Nov. 15, 1988

[54] WIRE CONNECTOR

[76] Inventor: William T. Auclair, Pinney St., Winsted, Conn. 06098

[21] Appl. No.: 95,841

[22] Filed: Sep. 14, 1987

[51] Int. Cl.[4] ..... H01R 4/36; H01R 4/38

[52] U.S. Cl. ..... 439/793; 439/92; 439/811

[58] Field of Search ..... 439/790, 792, 793, 796, 439/797, 801, 810, 811, 812, 814, 92

[56] References Cited

U.S. PATENT DOCUMENTS

| | | | |
|---|---|---|---|
| 254,473 | 3/1882 | Gates . | |
| 255,661 | 3/1882 | Paul . | |
| 1,981,685 | 11/1934 | Blackburn et al. | 439/793 |
| 2,032,394 | 3/1936 | Becker, Sr. et al. . | |
| 2,094,392 | 9/1937 | Winslow, Jr. et al. . | |
| 2,631,346 | 3/1953 | Wengen et al. . | |
| 3,032,849 | 5/1962 | Cohen et al. . | |
| 3,228,094 | 1/1966 | Stanback et al. . | |
| 3,426,319 | 9/1969 | Downs et al. . | |
| 3,736,550 | 5/1973 | Wallace et al. . | |
| 3,760,341 | 9/1973 | Grad . | |
| 4,020,531 | 5/1977 | Ahrens et al. . | |
| 4,526,437 | 7/1985 | Kies . | |

FOREIGN PATENT DOCUMENTS

| | | | |
|---|---|---|---|
| 433476 | 9/1967 | Switzerland | 439/793 |
| 4141 | of 1885 | United Kingdom | 439/812 |
| 247724 | 2/1926 | United Kingdom | 439/811 |

*Primary Examiner*—Eugene F. Desmond

*Attorney, Agent, or Firm*—Chilton, Alix & Van Kirk

[57] ABSTRACT

A wire connector for ground wires employs a pair of jaw members adapted for clamping to an I-beam. A head assembly includes a threaded shaft for securing the jaw members in clamped relationship. A bifurcated slot extends through the head assembly. The slot is selectively dimensioned to receive a ground wire which is secured in fixed position by a set screw.

14 Claims, 1 Drawing Sheet

WIRE CONNECTOR

BACKGROUND OF THE INVENTION

This invention relates generally to connectors for wire conductors. More particularly, the present invention relates generally to wire connectors employed as ground terminals for securing a ground wire for an electrical system or appliance.

Wire terminal devices of numerous types and configurations have been advanced for receiving wires in selectively dimensioned slotted openings and securing the wires in fixed position. For example, U.S. Pat. No. 3,426,319 discloses a neutral wire connector for electrically interconnecting a plurality of aluminum or copper wires. The device employs a plurality of wire receiving and screw receiving openings selectively dimensioned and shaped for receiving wires of various dimensions to secure the wires in place. Numerous devices have also been advanced to provide connectors for ground connections. For example, U.S. Pat. No. 4,526,437 discloses an electrical bracket wherein a connecting wire is seated between a ground rod and an acute corner of a bent sheet metal receiving member. A bolt engages screw threads of the member to clamp a connecting wire against the ground rod. Another conventional ground wire connector employs opposing clamp halves which are bolted together around a pipe or conduit. A boss extends from one clamp half. A ground wire is inserted through an opening of the boss and secured by tightening a set screw.

SUMMARY OF THE INVENTION

Briefly stated, the invention in its preferred form is a wire connector which functions as a ground clamp for clamping a ground wire to an I-beam or like member. The connector comprises a clamp having a pair of cooperative jaws which clamp onto the I-beam or structure. A shaft is threaded to one of the jaws. A head assembly is fixed to the shaft, and is engageable against the other jaw for securing the jaws in a clamped relationship. The head assembly comprises a head which defines a bifurcated slot. The slot has an enlarged first section having a first pre-established diameter and a contiguous diametral reduced second section having a second pre-established diameter. The second diameter is less than the first diameter. A set screw is threadably mounted to the head and positionable relative to the slot for engaging against a wire received in the slot to secure the wire in a fixed position therein. A wire having a diameter between the first and second pre-established diameters is securable in the enlarged slot section whereas a wire having a diameter less than the second pre-established diameter is securable in the reduced section. An electrically conductive path extends from the wire through the connector to the I-beam or other mounting structure.

The reduced slot section has a closed end with the set screw having an engagement end which is axially spaced at least a pre-established distance from the closed end to prevent damage or breaking of the ground wire. In a preferred form, the head has an axially extending hex-sided configuration and the bifurcated slot extends through opposing sides of the head.

One of the jaws forms an axially extending channel which defines a pair of laterally spaced tongues. One jaw forms a rail which is slidably received in the channel. The rail defines a pair of guide grooves which receive the tongues. The jaws each define an array of projecting gripping teeth. In one embodiment, the enlarged slot section is selectively dimensioned to receive six and eight gauge wires while the reduced slot section is selectively dimensioned to receive ten, twelve and fourteen gauge wire.

An object of the invention is to provide a new and improved wire connector which functions as a ground clamp for securing a ground wire to an I-beam or other structure.

Another object of the invention is to provide a new and improved wire connector of efficient form and having a relatively inexpensive construction.

A further object of the invention is to provide a new and improved wire connector which may be relatively efficiently mounted in position and a ground wire secured thereto in an efficient manner which minimizes the potential for damage or breakage of the ground wire.

A further object of the invention is to provide a new and improved wire connector for a ground wire which provides a rigid secure mounting engagement of high durability and is adapted for receiving ground wires having a wide variety of gauges or diameters and securing same in place without danger of improperly securing or damaging the ground wires.

Other objects and advantages of the invention will become apparent from the drawings and the specification.

DETAILED DESCRIPTION OF THE INVENTION

Figure 1:
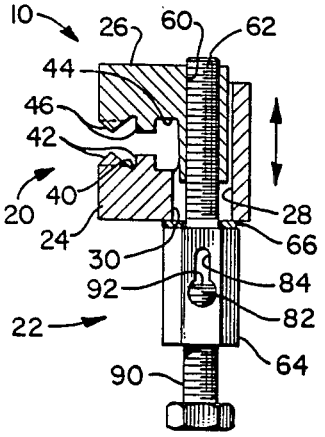
FIG. 1 is a side elevational view, partly in section, of a wire connector in accordance with the present invention.
Figure 2:
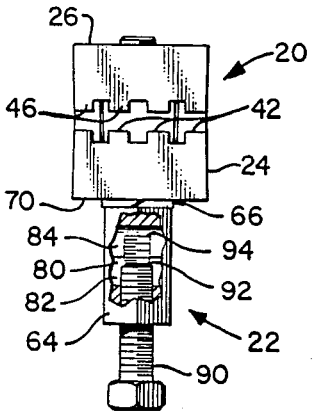
FIG. 2 is a front view, partly broken away and partly in section, of the wire connector of FIG. 1.
Figure 3:
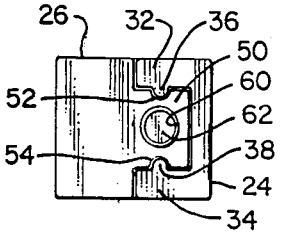
FIG. 3 is a top view of the wire connector of FIG. 1.

With reference to the drawings, wherein like numerals represent like part throughout the several figures, a wire connector in accordance with the present invention is generally designated by the numeral 10. Wire connector 10 is especially adapted to function as a ground clamp for clamping to an I-beam 12 to connect a ground wire 14 to provide an electrical ground connection therewith. In this regard, the wire connector is preferably formed from copper, brass or other metal components which have a high conductivity.

The wire connector 10 generally comprises a clamp 20 of quasi rectilinear form which clamps the connector in position to a conductive structure and a terminal head assembly 22 which functions to receive a ground wire and to securely fasten the ground wire to the connector.

The clamp 20 comprises a pair of cooperative jaw members 24 and 26 which are transversely positionable (in the direction of the FIG. 1 arrows) for engaging opposing sides of a conductive structure to clamp the connector in position. Jaw member 24 has a quasi L-shaped section which forms a generally transversely extending channel 28. The channel extends through an opening 30 defined in a bottom wall of jaw member 24. The channel 28 is defined by upstanding laterally spaced skirts 32 and 34. Transversely extending, parallel guide tongues 36 and 38 traverse the respective skirts 32 and 34. An upper surface 40 of the jaw member 24 forms a clamping surface having an array of projecting clamp or gripper teeth 42. Two rows of four teeth 42 are provided in the illustrated embodiment.

Jaw member 26 has a quasi inverted L-shaped section which forms a clamping surface 44 opposite surface 40. Clamping teeth 46 project from surface 44 to generally cooperatively oppose and align with teeth 42. Jaw member 26 has a transversely extending rail 50 which is complementary in shape to channel 28 and is loosely receivable therein for slidable transverse movement therealong. Rail 50 includes transversely extending, parallel, laterally spaced guide grooves 52 and 54 which mate with the corresponding tongues 36 and 38 of jaw member 24. It will be appreciated that the foregoing tandem tongue and groove configuration functions to retain the jaw members in coupled, transversely slidable relationship.

Figure 4:
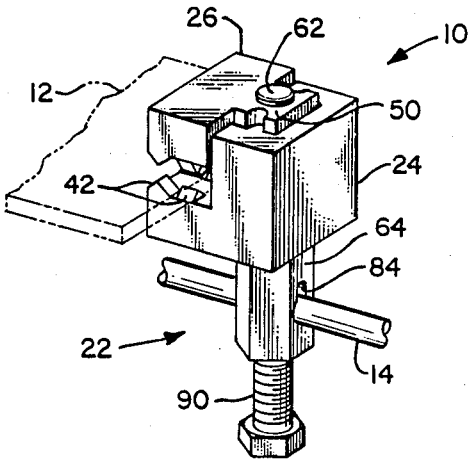
FIG. 4 is a perspective view of the wire connector of FIG. 1 illustrated in clamped engagement to a portion of an I-beam with a wire being connected thereto.

Jaw member 26 includes a threaded opening 60 which traverses the length of the rail 50 and is adapted for receiving a threaded shaft 62. Shaft 62 axially projects in fixed relationship from a hex head 64. A lock washer 66 is interposed between one bearing end 68 of the hex head 64 and the underside 70 of jaw member 24. Shaft 66 essentially functions as a worm screw to control the transverse spacing between the jaw members. The transverse spacing between the cooperative jaw members is thus defined by the threaded engagement position of shaft 62. The lock washer 66 is carried on the shaft so as to engage the underside 70 of the jaw member 24 to firmly lock the jaw members in a clamped engagement with I-beam 12 (or other structures) as best illustrated in FIG. 4. A wrench or suitable tool may be applied to the hex head 64 to loosen the jaw members for initial mounting and to tighten the clamping engagement between the jaw members.

A bifurcated through slot 80 traverses through opposing sides of the hex head 64. Bifurcated slot 80 includes an enlarged round opening section 82 and an elongated diametrically extending, reduced slot section 84. Slot section 84 has a diameter which is less than the diameter of the enlarged section 82. The slot portions are selectively dimensioned so that specific dimensioned ground wire or wire of selected gauges may be inserted or received therein. For example, in one embodiment of the invention, section 82 is dimensioned, e.g. 0.192 inch diameter, so that six gauge wire and eight gauge wire can be received therein while the reduced slot section 84 is not large enough to receive eight gauge wire, e.g. less than 0.150 inch, but ten, twelve and fourteen gauge wire may be received in the reduced slot section 84. It will be appreciated that a large gauge wire can not be inserted into the reduced slot section 84. Likewise a small gauge wire can not be fixably retained in the enlarged slot section 82 but will be ordinarily displaced into the reduced section 84.

A set screw 90 is threadably received at the distal axial end of the hex head 64. The set screw 92 has a wire engagement end 92. Screw end 92 is engageable against wire received in either section 82 or 84 so that upon threadably tightening the set screw 90 against the received wire, the wire may be clamped against slot defining portions of the hex head and secured in fixed position. The hex head 64 has a threaded surface 94 which axially extends so as to terminate at a pre-established axial distance from the closed end of the reduced slot section 84. The axial spacing from the terminus of the threaded surface 94 is selected, for example, so that fourteen gauge wire, i.e. wire having a diameter of 0.080 inch is not so compressed or deformed by excessively tightening the set screw that the wire will break away or break off from the wire connector.

Figure 5:
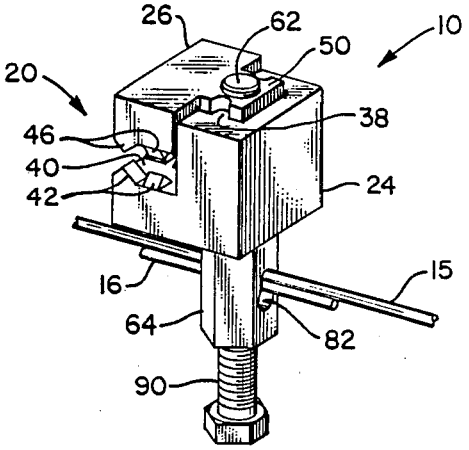
FIG. 5 is a perspective view of the wire connector of FIG. 1 illustrating a second wire connecting mode of the connector.

As best illustrated in FIG. 5, when the wire connector 10 is employed for connecting fourteen, twelve or ten gauge wire (exemplified by wire 15), a one-inch section 16 of the ground wire is also inserted into the reduced slot section 84 and the set screw is tightened against the short section 16 to secure the ground wire 15 in fixed position and to partially absorb and distribute the clamping forces of the set screw to thereby prevent damage to the ground wire 15.

Figure 6:
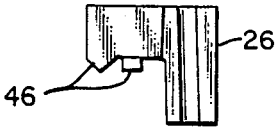
FIG. 6 is a side view of another clamp component of the wire connector of FIG. 1.
Figure 7:
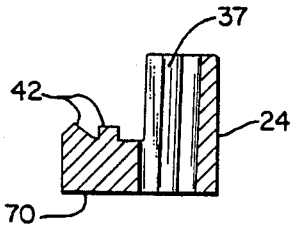
FIG. 7 is a sectional view of a clamp component of the wire connector of FIG. 1.

With reference to FIGS. 6 and 7, in one form of the invention, the guide tongues 37 (only one illustrated) are oriented at an oblique angle to a lateral plane or transverse axis of the clamp 20 so that the jaw members may cooperate to engage opposing surfaces of an I-beam or other structure of a type wherein the opposing surfaces are not precisely parallel but are oriented at slight angles to each other. It should be appreciated that either jaw member 24 or 26 may have the tongues and the other jaw member the complementary grooves.

The hex head 64 is preferably configured so that the hex head may be engaged with the working or box end of a conventional wrench for rotatably opening and closing the clamp jaws. The clamp 20 is positioned on an I-beam portion 12 such as illustrated in FIG. 4. A wrench (not illustrated) such as a 7/16 inch wrench is employed to tighten the jaws by applying a torque to the hex head. The ground wire set screw 90 is then loosened by a wrench such as ⅜ inch wrench (or manually), and a ground wire such as ground wire 14 (which may be a six gauge wire) is inserted into slot 80. The set screw is then tightened by the wrench so as to secure the ground wire 14 in position. A warning tag (not illustrated) may be mounted to the free end of the ground wire 14.

With reference to FIG. 5, as previously described, when using fourteen, twelve or ten gauge wire or other wire having a relatively small diameter, a one-inch section of the wire is preferably inserted in slot section 82 between the end 92 of the set screw and the wire to prevent damage to the ground wire. The process of tightening the set screw 90 will force the wires 15 and 16 toward the end of slot section 84 regardless of whether the wires are initially inserted in section 82 or 84.

The set screw 90 may also be used to mount a perforated metal ribbon or braid (not illustrated) to the connector.

It will be appreciated that the wire connector 10 as described provides an efficient means for rigidly clamping a ground wire to an I-beam or similar structure without damaging the ground wire and/or the connecting portions of the ground wire. The wire connector 10 provides an electrically conductive path between the ground wire and the I-beam or associated structure. A single wire connector 10 is readily adaptable for implementing a ground connection of high integrity with wire of any of a wide variety of wire gauges. The connector may be suitably dimensioned as the applications dictate. The terminal head assembly 22, which in the preferred illustrated embodiment consists of only three separable discrete components, functions not only to lock the jaw members in clamping relationship but also functions as the ground terminal for connecting the wire.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A wire connector comprising:

clamp means comprising a pair of cooperative jaw members for clamping an object in clamped relationship between said jaw members;

clamp securement means comprising a shaft threaded to one of said jaw members and a head assembly fixed to said shaft and engageable against said other jaw member for securing said jaw members in clamped relationship;

slot defining means in fixed relationship with said clamp securement means for defining a bifurcated slot having an enlarged first section having a first pre-established diameter and a contiguous reduced second section having a second pre-established diameter and at least partially defined by a closed end generally diametrically opposite the enlarged first section, said second diameter being less than said first diameter; and wire securement means positionable in said slot for engaging against a wire received in said slot to securably connect said wire in fixed position therein wherein a wire having a diameter between said first and second pre-established diameters is securable in said enlarged section and a wire having a diameter less than said second pre-established diameter is securable in said reduced section whereby said connector defines an electrically conductive path which extends between said wire and said object.

2. The wire connector of claim 1 wherein said wire securement means further comprises a set screw having an engagement end, said screw being threaded to said head assembly, said engagement end being axially positionable relative to said slot.

3. The wire connector of claim 2 wherein said set screw engagement end is constantly axially spaced at least a pre-established distance from said closed end.

4. The wire connector of claim 1 wherein said head assembly comprises an axially extending hex-sided head and said bifurcated slot extends through opposing sides of said head.

5. The wire connector of claim 4 wherein said shaft projects axially from one end of said head and said wire securement means is threadably mounted at the opposite axial end of said head.

6. The wire connector of claim 1 wherein a said jaw member forms an axially extending channel defining a pair of laterally spaced tongues and the other said jaw member forms a rail received in said channel for sliding movement therealong to define the transverse spacing between said jaw members, said rail defining a pair of grooves mating with said tongues.

7. The wire connector of claim 6 wherein each said jaw member defines an array of projecting gripping teeth.

8. The wire connector of claim 6 wherein said tongues are oriented at an angle generally oblique to the transverse axis of the jaw members.

9. The wire connector of claim 1 wherein said enlarged slot section is dimensioned to receive a 6 gauge wire and said reduced slot section is dimensioned to receive a 10 gauge wire.

10. A wire connector comprising:

clamp means comprising a pair of coorperative jaw members each having opposing arrays of gripping structures for clamping an object in clamped relationship between said jaw members;

clamp securement means threadably positionable in one jaw member and engageable against the other jaw member for securing said jaw members in clamped relationship;

a head assembly mounted to said clamp means comprising slot defining means for defining a bifurcated slot having an enlarged first section having a first pre-established diameter and a contiguous diametral reduced second section having a second pre-established diameter and at least partially defined by a closed end generally diametrically opposite the enlarged first section, said second diameter being less than said first diameter; and a set screw threaded to said head assembly and comprising an engagement end positionable in said slot for engaging against a wire received in said slot to securably connect said wire in fixed position therein wherein a wire having a diameter between said first and second pre-established diameters is securable in said enlarged section and a wire having a diameter less than said second pre-established diameter is securable in said reduced section.

11. The wire connector of claim 10 wherein said set screw engagement end is constantly spaced at least a pre-established distance from said closed end.

12. The wire connector of claim 10 wherein said enlarged slot section is dimensioned to receive a 6 gauge wire and said reduced slot section is dimensioned to receive a 10 gauge wire.

13. The wire connector of claim 10 wherein said head assembly comprises an axially extending hex-sided head and said bifurcated slot extends through opposing sides of said head.

14. The wire connector of claim 13 further comprising a threaded shaft extending in fixed relationship from said head, said shaft being threadably engagebale with said clamp means for mounting said head to said clamp means.

* * * * *